US006340130B2

(12) United States Patent
Wild et al.

(10) Patent No.: US 6,340,130 B2
(45) **Date of Patent: *Jan. 22, 2002**

(54) APPARATUS AND METHOD FOR SUPPLYING FOILS

(75) Inventors: Hans-Peter Wild, Zug (CH); Eberhard Kraft, Neckarbischofsheim (DE)

(73) Assignee: INDAG GmbH & Co. Betriebs-KG (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/316,999

(22) Filed: May 24, 1999

(30) Foreign Application Priority Data

Jun. 3, 1998 (DE) ..... 198 24 798

(51) Int. Cl.[7] ..... B65H 23/185

(52) U.S. Cl. ..... 242/420.6; 156/324; 156/494; 156/544

(58) Field of Search ..... 242/413.6, 420.6, 242/420.3; 156/544, 324, 494, 543, 545–555

(56) References Cited

U.S. PATENT DOCUMENTS

| | | | | | |
|---|---|---|---|---|---|
| 2,603,428 | A | * | 7/1952 | Newcombe | 242/420.6 |
| 2,825,016 | A | * | 2/1958 | Bailey | 242/420.6 |
| 3,341,148 | A | * | 9/1967 | Cooper | 242/413.6 |
| 3,661,338 | A | * | 5/1972 | Becking | 242/413.6 |
| 3,684,205 | A | * | 8/1972 | Rogow | 242/413.6 |
| 4,530,471 | A | * | 7/1985 | Inoue | 242/420.6 |
| 4,582,271 | A | * | 4/1986 | Takahashi | 242/420.6 |
| 4,770,366 | A | * | 9/1988 | Hood et al. | 242/420.6 |
| 4,804,898 | A | | 2/1989 | Nordlof et al. | 318/569 |
| 4,995,564 | A | * | 2/1991 | Zuliani | 242/413.6 |
| 5,713,533 | A | * | 2/1998 | Nordlof et al. | 242/420.6 |
| 5,951,801 | A | * | 9/1999 | Weissenfluh et al. | 156/544 |

FOREIGN PATENT DOCUMENTS

| | | |
|---|---|---|
| AT | 368973 | 11/1982 |
| DE | 2236524 | 2/1974 |
| DE | 2442610 A1 | 3/1976 |
| DE | 2534306 A1 | 7/1976 |
| DE | 2513776 A1 | 10/1976 |
| DE | 2700971 A1 | 8/1977 |
| DE | 3425430 A1 | 1/1986 |
| DE | 3631940 A1 | 4/1987 |
| DE | 3727339 A1 | 3/1989 |
| DE | 4114255 A1 | 4/1992 |
| DE | 4225061 A1 | 3/1993 |
| DE | 4446104 A1 | 7/1996 |
| DE | 19502830 A1 | 8/1996 |
| DE | 29521183 U1 | 11/1996 |
| DE | 4446104 C2 | 4/1997 |
| EP | 0159718 | 10/1985 |
| EP | 0249114 | 12/1987 |
| FR | 2211933 | 7/1974 |
| GB | 684234 | 12/1952 |
| GB | 1126985 | 9/1968 |
| WO | WO91/18797 | 12/1991 |

* cited by examiner

*Primary Examiner*—John M. Jillions
(74) *Attorney, Agent, or Firm*—Seed Intellectual Property Law Group PLLC

(57) ABSTRACT

The present invention relates to an apparatus for supplying foil material, the apparatus comprising a motor-driven supply roll, a withdrawal means and a consumption sensor provided between the supply roll and the withdrawal means for controlling the drive of the supply roll in response to the consumption of foil material, and at least one stationary deflection roller, at least one sensor roller and a sensor means, the sensor roller being supported and arranged such that it changes the distance from the stationary deflection roller in response to the difference between supply capacity and withdrawal capacity of the foil material, and the sensor means senses said change in distance and accelerates the supply roll when the distance is smaller than a first predetermined distance, and slows down the supply roll when a second predetermined distance is exceeded. Furthermore, the invention relates to a corresponding method for supplying foil material.

21 Claims, 4 Drawing Sheets

APPARATUS AND METHOD FOR SUPPLYING FOILS

The present invention relates to an apparatus for supplying foil material, for example for producing foil bags, wherein foil material is supplied by a supply roll and is withdrawn by a withdrawal means, and to a corresponding method.

In a process in which foil material is supplied by a supply roll in one piece and is removed by a withdrawal means to be further processed, wherein the withdrawal means has a predetermined rate or speed adapted to the processing speed of subsequent processing stations, the foil material in front of the withdrawal means must be under tension. The supply roll is rotatably supported and is rotated by the withdrawn foil.

Such a foil supply means is e.g. needed for producing foil bags. Such foil bags comprise, for example, two rectangular side foils which in the filled state are respectively sealed to each other at the side edges. A bottom or stand-up foil is optionally sealed in between the four edges and is folded open such that there is room for filling material in the foil bag. Such a filling material may e.g. be a beverage.

In known supply means the tension in front of the withdrawal means is provided by a co-called tensor means. The foil is guided over a plurality of stationary and movable rollers which are alternately arranged. The movable rollers are biased by a spring force which becomes the greater the smaller the distance becomes between the movable and the stationary deflection rollers. The foil is thus tensioned all the time.

In such a prior-art supply means the withdrawal force which is needed for withdrawing a certain amount of foil material from the supply roll is not constant, as the diameter of the supply roll is decreasing the more the foil material is unwound, and the torque to be applied thus changes accordingly, as a result of which the tension of the foil changes. On the other hand, the tension of the foil is not constant since the tensor means does not exert a constant force on the foil material when the distance between the movable and the stationary deflection rollers changes since the spring force which acts on the movable rolls is in proportion to the longitudinal extension of the spring.

However, in view of the high precision needed for producing foil bags, with very high speeds being realized in an automatic supply means, it is very important that the foil material be supplied in an exact manner. Therefore, the tension in front of the withdrawal means should be as constant as possible.

It is therefore the object of the present invention to provide an apparatus and a method for supplying foil, with the help of which a substantially constant tension is achieved in front of the withdrawal means.

In the supply method according to the invention, the foil material is supplied by a motor-driven supply roll, subsequently guided around at least one stationary deflection roller and at least one sensor roller whose distance from the at least one deflection roller is variable, and is finally withdrawn by a withdrawal means, the speed of the drive of the supply roll being increased when the distance of the sensor roller from the deflection roller is smaller than a first predetermined distance, and the speed of the drive being reduced when the distance of the sensor roller from the deflection roller exceeds a second predetermined distance.

To this end, the supply apparatus of the invention is provided with a motor-driven supply roll having a supply capacity, with a withdrawal means having a withdrawal capacity, and with a consumption sensor by which the drive of the supply roll is controlled in response to the consumption of foil material, and which is arranged between the supply roll and the withdrawal means, wherein the consumption sensor comprises at least one stationary deflection roller, at least one sensor roller which is supported and arranged such that it changes its distance from the deflection roller in accordance with the difference between supply capacity and withdrawal capacity, and a sensor means which senses the change in distance and which increases the speed of the drive of the supply roll when the distance is smaller than a first predetermined distance and which decreases the speed of the drive when a second predetermined distance is exceeded.

Thanks to the method of the invention and the apparatus of the invention, the motor drive of the supply roll achieves the effect that no additional force is needed for the withdrawal operation. As a result, a varying withdrawal force is not observed either when the actual diameter of the supply roll is changed by the measure of unwinding the foil material. However, the supply roll is not driven in a uniform manner. When the rotation of the supply roll is slowed down, the distance between the at least one sensor roller and the at least one deflection roller is reduced by the withdrawal means. The force which is here exerted by the sensor roller on the foil material is constant, so that the tension applied to the foil material in front of the withdrawal means remains constant during said process. It is only when the sensor roller has a distance which is smaller than a first predetermined distance from the deflection roller that the drive of the supply roll is accelerated by a sensor means. The distance of the at least one sensor roller from the at least one stationary deflection roller is then increased again accordingly. However, during such a process the tension in front of the withdrawal means is also determined by the force which is exerted by the sensor roller on the foil material, and is thus constant since no spring elements are provided for. Hence, a constant tension of the foil material is ensured during the entire operation with the method according to the invention and with the apparatus according to the invention.

A deceleration or acceleration of the supply roll without the roll being entirely stopped may be advantageous in cases where very large and thus heavy supply rolls are used. The forces exerted on the drive of the supply roll are thereby reduced. In another development the supply roll is possibly completely switched off when the second predetermined distance is exceeded, and is possibly switched on again when the distance is smaller than the first predetermined distance. Such a design may be of advantage in cases where the position of the sensor roller should be corrected as fast as possible or where the control unit should have a design which is as simple as possible.

The sensor roller may be freely suspended e.g. held by the foil. Advantageously, however, there is provided a guide means along which the at least one sensor roller moves while the distance is changed so as to ensure a reliable guidance of the at least one sensor roller without the occurrence of any malfunctions caused by a displacement.

A particularly frictionless sliding movement of the sensor roller within the guide means is accomplished when said means is oriented in a substantially vertical direction.

The at least one sensor roller can maintain the constant tension within the foil material by its own weight. Depending on the demands, it may additionally be loaded by further weights to adjust a predetermined tension.

According to a preferred development, the sensor means comprises a first sensor which outputs a signal for accelerating the drive when the distance of the at least one sensor roller from the at least one deflection roller is smaller than a first predetermined distance. In a further development, the sensor means comprises a second sensor which outputs a signal for slowing down the drive when the distance of the at least one sensor roller from the at least one deflection roller exceeds the second predetermined distance. With such sensors, the motor control can be realized in a very simple way.

In an advantageous further development, the apparatus according to the invention comprises a first safety sensor which produces an error signal when the at least one sensor roller has a distance smaller than the minimum distance from the at least one deflection roller. In a further development the sensor means comprises a second safety sensor which produces an error signal when the at least one sensor roller exceeds a maximum distance from the at least one deflection roller. Should a malfunction occur or should the supply roll be completely unwound, an error signal is produced in these further developments, for instance, in order to produce an alarm signal for warning the operating personnel.

The sensors or safety sensors may e.g. be formed by mechanical switches which are activated by the moving sensor roller. By contrast, a particularly simple and reliable configuration provides for optical sensor elements, such as light barriers. The movement of the sensor roller is not influenced by the contactless operation of such optical sensors, whereby the constant tension of the foil material is further maintained.

In another embodiment proximity switches are provided as sensors or safety sensors which ensure a simple and reliable structure which, in addition, is less prone to soiling.

In an advantageous development of the method according to the invention, the withdrawal means and the operational components for the further processing of the foil are switched off when the distance is smaller than a minimum distance. In case of a malfunction, or in cases where the supply roll is not entirely unwound, the feeding operation will thus be interrupted until a normal operation is possible again. According to a further development, the motor of the supply roll, the withdrawal means and the operational components for further processing the foil are switched off when a maximum distance of the at least one sensor roller from the at least one deflection roller is exceeded. When a maximum distance is exceeded, there is obviously a malfunction in the discharge of the foil material, so that the motor of the supply roll must be switched off in addition to interrupt the further supply.

For implementing such developments of the method according to the invention, an advantageous development of the apparatus according to the invention provides that the error signal which is produced by the respective safety sensors should be used at least for switching off the withdrawal device and those operational components that are used for the further processing of the foil supplied.

Depending on the respective demands, the withdrawal means is operated continuously. Even in the case of an intermittent operation of the withdrawal means, the apparatus of the invention and the method of the invention can advantageously be used since the apparatus according to the invention and the method according to the invention also ensure in such a case that the tension of the foil material in front of the withdrawal means remains constant.

If a plurality of individual foil webs are required for the further processing of the foil, the apparatus according to the invention can be used in a plurality of parallel supply means repeatedly. For instance, two foil webs can be used for supplying foil material to form the respective two side foils of a foil bag. Advantageously, the motors of the supply rolls are activated independently of each other by a joint control unit.

The method according to the invention and the apparatus according to the invention will now be explained in more detail with reference to the enclosed drawings, in which.

Figure 1:
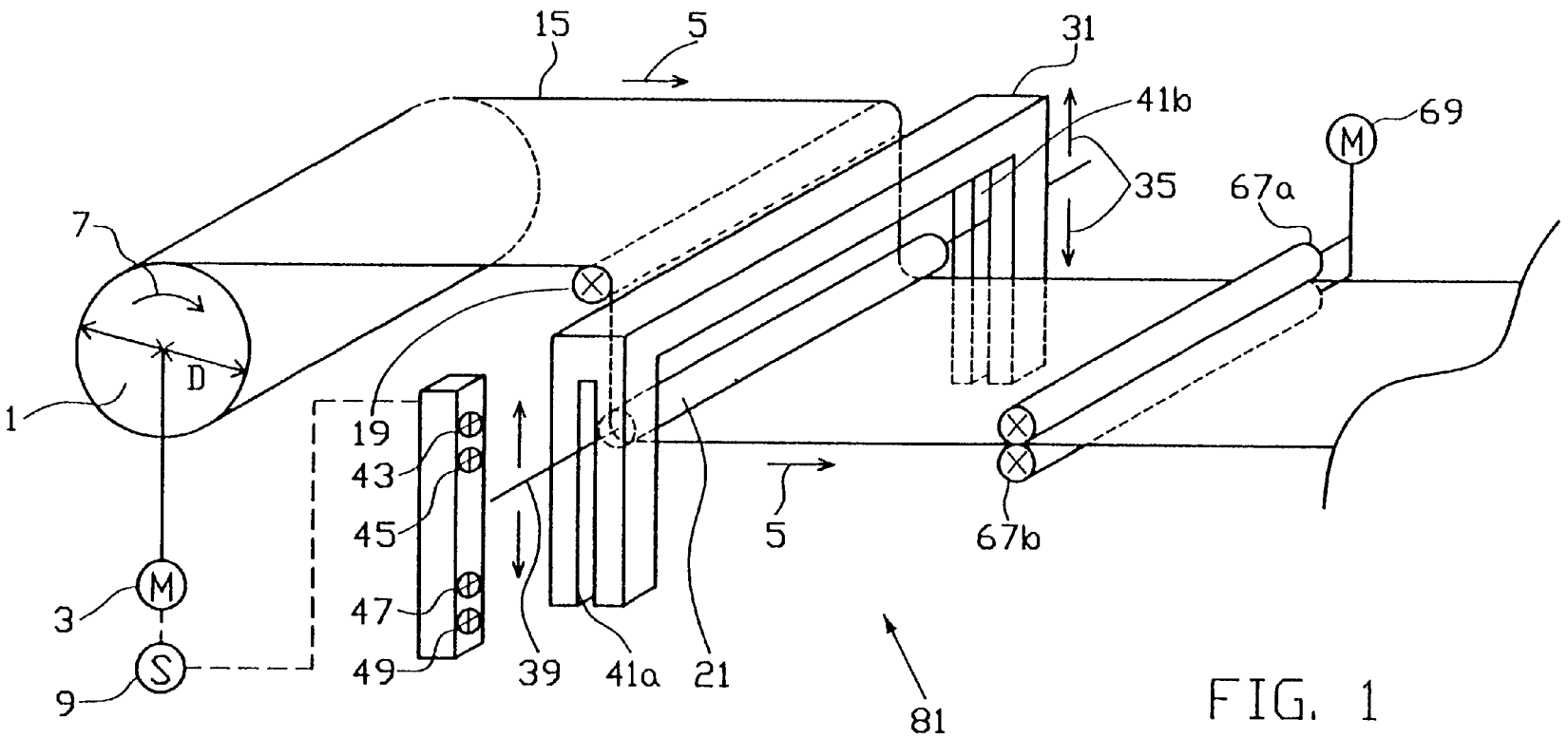
FIG. 1 is a perspective, schematic view of a first embodiment of the apparatus according to the invention.

FIGS. 1 and 2*a–c* show a first embodiment of the apparatus according to the invention. 1 designates a supply roll having a diameter D which is decreasing with a progressive unwinding operation. Foil 15 is unwound from the supply roll 1 and guided in a consumption sensor 81 around a stationary deflection roll 19 and a movable sensor roller 21. 67*a* and 67*b* schematically illustrate a withdrawal means, for example rollers which are connected to the foil by frictional grip and are operated at a speed or rate corresponding to the further foil processing operation. The actual design of motors 3 and 69, respectively, of the supply roll 1 and the withdrawal means 67*a*, 67*b*, respectively, is here of no interest, so that the motors are only shown in a schematic matter. The movement of the foil material is outlined by arrow 5. The sensor roller 21 is supported in guide means 41*a* and 41*b* which are vertically provided in a guide frame 31. In the extension of the axis of the sensor roller there is provided a trigger means 39 which upon movement of the sensor roller 21 in an upward or downward direction is moved past light barriers 43, 45, 47 and 49. The sensors are connected via a signal line to the control unit 9 of the motor 3 of the supply roll 1. The upward and downward movement of the sensor roller 21 is indicated by the arrows 35, and the rotational movement of the supply roll is indicated by the arrow 7.

Depending on the application, the withdrawal means 67*a*, 67 may have provided upstream thereof further components which serve to process the foil, e.g. a sealing or welding means for forming weld seams in the foil material, a punching means for forming holes, or the like.

Figure 2A:
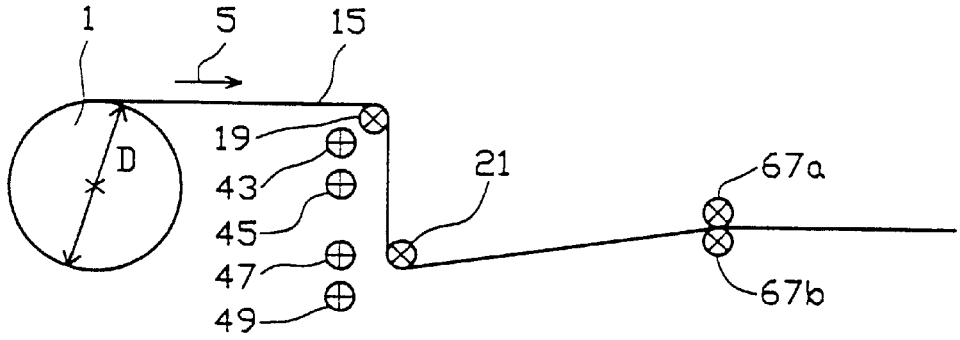
FIGS. 2*a–c* shows various operative states of the first embodiment of the apparatus according to the invention.
Figure 2B:
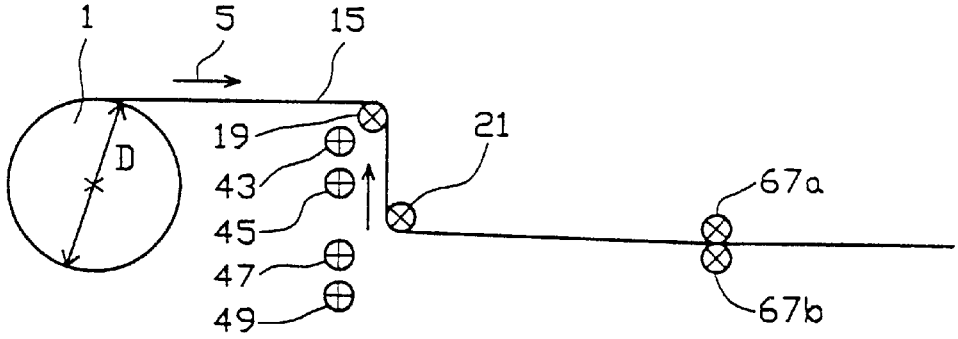
Figure 2C:
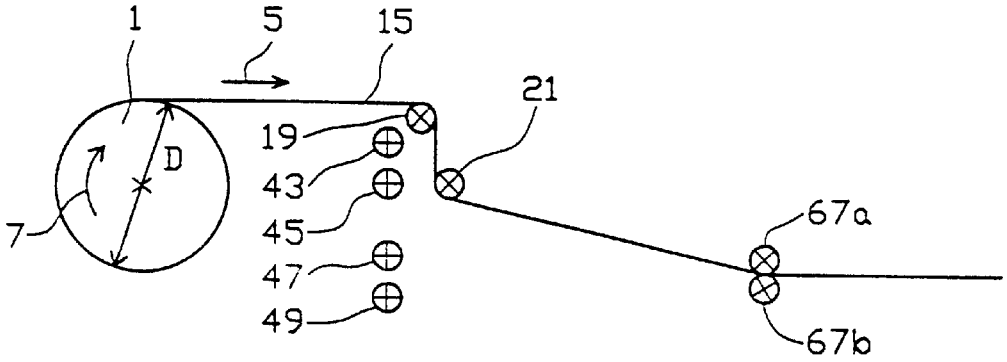

FIG. 2*a* shows an operative state of the first embodiment of the apparatus according to the invention, wherein the sensor roller 21 reaches its lowermost state during normal operation, i.e. at the level of sensor 47. FIG. 2*b* shows an intermediate state in which the sensor roller 21 moves upwards between sensors 45 and 47. FIG. 2*c* shows an operative state in which the sensor roller 21 reaches its highest point during normal operation, i.e. at the level of sensor 45.

The operation of the first embodiment of the apparatus according to the invention shall now be explained with reference to FIGS. 1 and 2. The withdrawal means 67*a*, 67*b* pulls the foil material 15 in the direction of arrow 5 due to the frictional grip existing between the withdrawal means and the foil. In the stationary state of the supply roll 1 the sensor roller 21 moves upwards in guides 41*a* and 41*b* due to the withdrawal force. When the sensor roller 21 reaches the level of the upper optical sensor (as is e.g. shown in FIG. 2*c*), the trigger 39 triggers the light barrier 45. The light barrier transmits a signal to the control unit 9 which, in turn, activates the motor 3 of the supply roll 1, so that the supply roll 1 rotates in direction 7. New foil material 15 is thereby supplied and the sensor roller 21 moves downwards in guides 41*a*, 41*b*. When the trigger 39 reaches sensor 47, said light barrier is activated. A signal is transmitted to the control unit 9 to switch off the motor 3 of the supply roll 9, as a result of which the further foil supply is stopped (FIG. 2*a*). As a consequence of the continuing withdrawal operation of the withdrawal means 67*a*, 67*b*, the sensor roller 21 moves up again, as shown in FIG. 2*b*. When the level of the sensor 45 is reached, as described above, the motor 3 of the supply roll 1 is again switched on.

The withdrawal means 67*a*, 67*b* can here be operated continuously or intermittently. In the case of an intermittent operation, the sensor roller 21 also moves upwards intermittently while moving.

After the supply roll 1 has been completely unwound, no further foil material can be supplied, i.e. even during the operation of the motor 3. The withdrawal means 67*a*, 67*b*, however, continues to operate. The sensor roller 21 moves upwards. The trigger 39 moves past the light barrier 45. However, no further foil material can subsequently be supplied. As a consequence, the sensor roller 21 moves further upwards. When the roller reaches an upper safety sensor 43, e.g. a light barrier again, an error signal is produced and all components of the foil supply means, including the withdrawal device 67*a*, 67*b*, are switched off. In addition, it is e.g. possible to produce an acoustic or optical signal which draws the attention of the operating personnel to the fact that a new supply roll 1 has to be inserted. Of course, the safety sensor 43 will also be responsive when the foil supply is interupted because of another malfunction, e.g. when the supply roll is jammed.

On the other hand, a malfunction of the control unit 9 or of the motor 3 may have the effect that the supply roll 1 is not switched off in time when the sensor roller 21 with the trigger 39 moves past the sensor 47. In such a case the sensor roller 21 will further move downwards in the guides 41*a*, 41*b* until it reaches a lower safety sensor 49, e.g. a light barrier again. This light barrier transmits a signal which switches off the entire system, including the supply roll 1 and the withdrawal means 67*a*, 67*b*, e.g. by interrupting the power supply. Furthermore, an acoustic or optical signal can be transmitted again which draws the attention of the operating personnel to a corresponding malfunction. The sensor 49 will also become operative when the foil material 15, for example, has been torn before reaching the sensor roller 21. In this case, too, the sensor roller 21 will move downwards past the sensor 47 to reach the sensor 49, and the operating personnel can be warned by the error signal. At the lower end of the guide rails 41*a*, 41*b*, or on a correspondingly provided support, the sensor roller 21 is stopped in its downward movement.

The structure and operation of a further embodiment of the apparatus according to the invention shall now be described with reference to FIGS. 3 and 5. The illustrated embodiment comprises two foil webs which extend in parallel and are united in front of the withdrawal means 68, 70. Such parallel foil supplies are e.g. needed when two foils are sealed to each other, for instance, in order to form foil bags. In the case of such an application the foils may e.g. be laminated aluminum foils. Upstream of the withdrawal means 68, 70, or also downstream thereof, a sealing means (not shown) may e.g. be provided.

Figure 3:
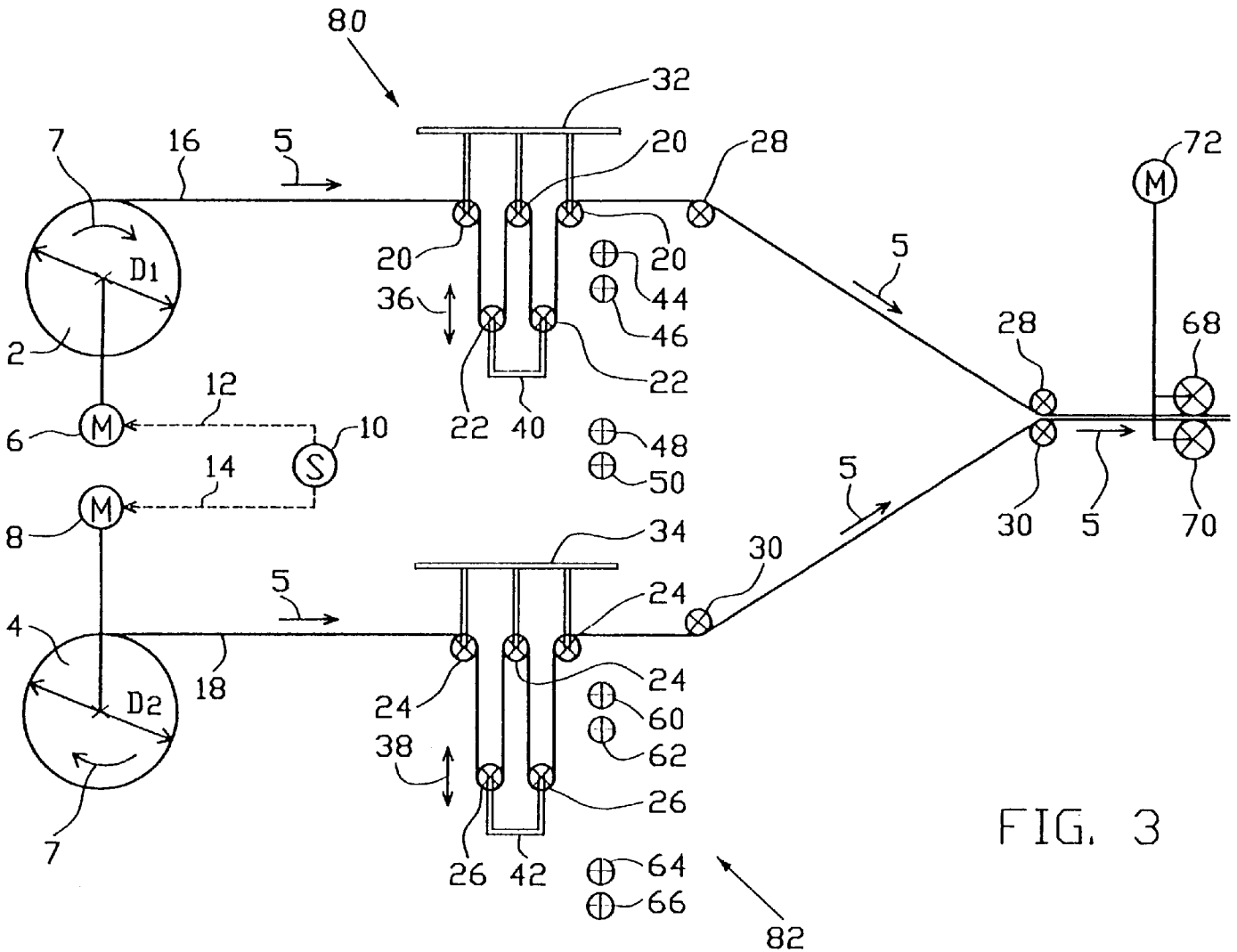
FIG. 3 is a schematic side view of a second embodiment of the apparatus according to the invention.

In FIG. 3, 2, 4 designate two supply rolls having diameters $D_1$ and $D_2$, respectively, for supplying the foil material 16, 18. The movement of the supply rolls is initiated by motors 6, 8 and is performed in the direction 7. The motors 6, 8 are controlled by a control unit 10 via signal lines 12, 14. The foils 16 and 18, respectively, enter into the consumption sensors 80, 82. In doing so, the foils 16 and 18, respectively, run around stationary deflection rolls 20 and 24, respectively, and around movable sensor rollers 22 and 26, respectively. In the embodiment shown in FIG. 3, each consumption sensor 80, 82 comprises three stationary deflection rolls 20 and 24, respectively, and two movable sensor rollers 22 and 26, respectively. The movable sensor rollers 22 and 26 are each interconnected through connections 40 and 42, respectively, so that the vertical movement of the sensor rollers 22 and 26, respectively, of each consumption sensor 80 and 82, respectively, takes place at the same time. The vertical movements of the sensor rollers 22, 26 are indicated by arrows 36, 38. 44 and 50 designate the safety sensors of the upper consumption sensor 80, and 60, 66 designate the safety sensors of the lower consumption sensor 82. 46 and 48 designate the sensors at the upper and lower deflection points of the sensor rollers 22 of the consumption sensor 80, and 62, 64 designate the corresponding sensors of the lower consumption sensor 82. The optical sensors are here e.g. designed as light barriers. Not shown are in FIG. 3 the signal lines that connect the individual light barriers to the control unit 10 for the motors 6, 8 of the supply rolls 2, 4. 28, 30 designate deflection rolls for the individual foils 16, 18 before these are withdrawn by the joint withdrawal device 68, 70, which is driven by the motor 72. 32, 34 designate stationary mounting means for the deflection rolls 20 and 24, respectively, of the individual consumption sensors.

Figure 4:
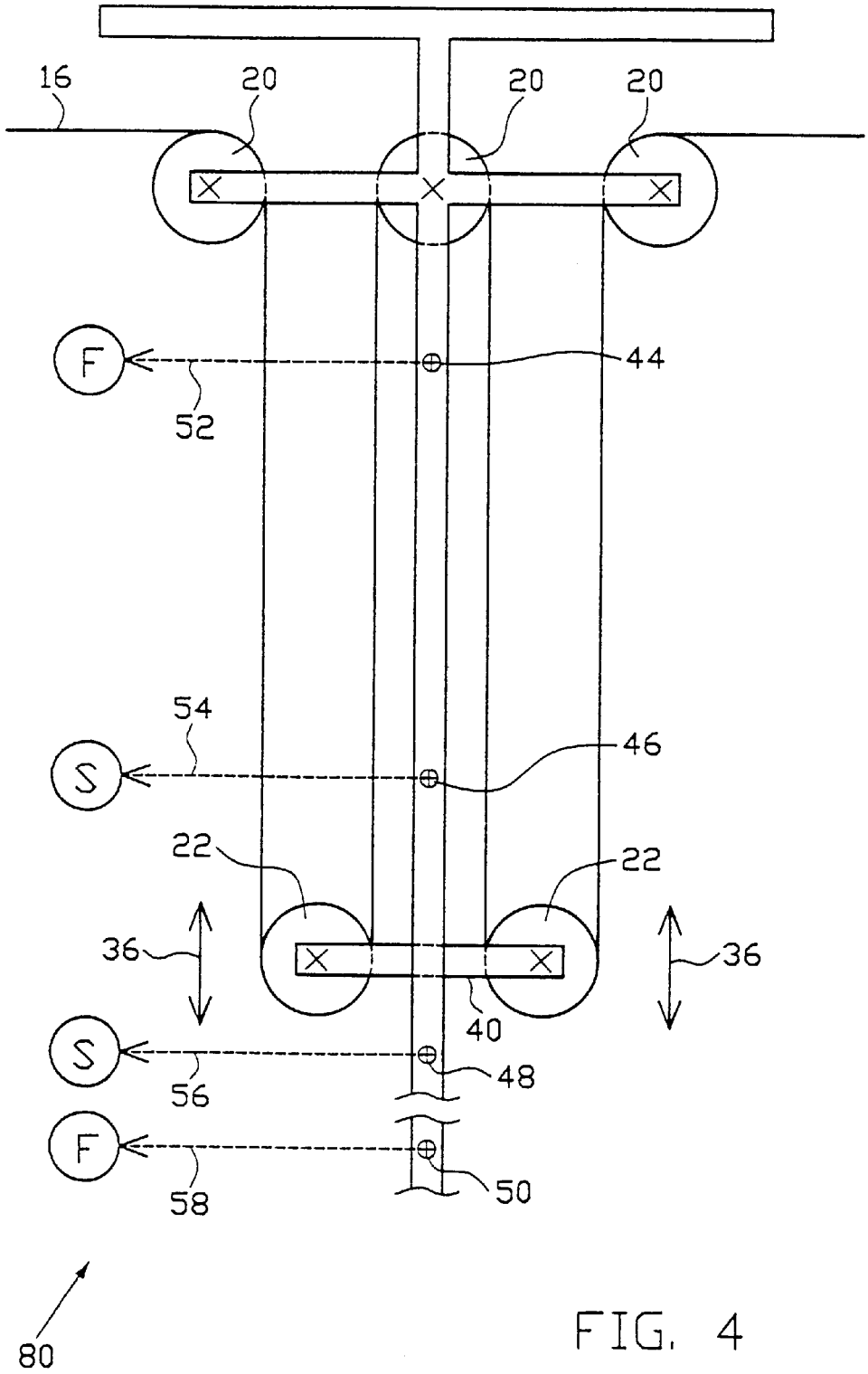
FIG. 4 shows a detail of FIG. 3, illustrating a consumption sensor of the second embodiment.

FIG. 4 is a detail view showing the consumption sensor 80. The consumption sensor 82 has an identical structure. Both the consumption sensors 80, 82 and the motors 6, 8 of the individual foil webs operate independently of each other. FIG. 4 shows the signal paths 52, 58 which supply an error signal F from the optical safety sensors 44, 50 whenever the connection 40 passes between them past the safety sensors 44 and 50, respectively. The mode of operation of the optical safety sensors for switching off the corresponding operational components is here identical with the first embodiment that has been described above. FIG. 4 also shows the signal paths 54, 56 of the sensors 46, 48 which effect the switching on or off of the motor 6 of the supply roll 2 in FIG. 3. In a manner comparable with the first embodiment, the motor 6 of the supply roll 2 is switched on when the level of the sensor roller 22 moves past the optical sensor 46, and the motor 6 is switched off when the level of the sensor roller 22 moves past the sensor 48. Thanks to the arrangement of the stationary deflection rollers 20 and the sensor rollers 22, and due to the provision of three deflection rollers 20 and two sensor rollers 22, a reliable guidance of the foil is ensured, as the position of the sensor rollers 22 is self-stabilizing.

Like in the case of the second embodiment, the first embodiment of FIGS. 1 and 2 can be used for supplying a plurality of foil webs on condition that a corresponding number of consumption sensors has been provided. On the other hand, a single consumption sensor, as is e.g. shown in FIG. 4 and illustrated in duplicate in FIG. 3, can also be used for supplying a single foil web.

When a plurality of foil webs, which e.g. form the side foils and the bottom foil of a stand-up bag, are supplied, there may be provided a correspondingly higher number of consumption sensors.

In the above description, an operation has been described in the case of which the supply roll is entirely stopped when a predetermined distance of the sensor roller has been exceeded, and the supply roll is again driven when the distance is smaller than a further predetermined distance of the sensor roll. Deviating from the above description, it is also possible that the supply roll is not completely switched off, but only slowed down when the sensor roll exceeds a predetermined distance, and the supply roll is accelerated when the distance is smaller than a further predetermined distance This may be advantageous when particularly large and correspondingly heavy supply rolls are used.

Both in the first embodiment and in the second embodiment as described above, the downward movement of the sensor rollers 21, 22 is started by their own weight during the foil supply operation. The tension of the foil material can here be adjusted by adjusting the weight of the sensor roller or by corresponding additional weights.

Since the sensor roller rests on the respective foil only with its weight or a corresponding additional weight, the exerted force is constant and the tension of the foil in front of the withdrawal means 67*a*, 67*b*, 68, 70 is constant. This ensures a very precise supply of the foil material which can also be maintained at very high operational speeds which are nowadays standard in foil processing lines.

What is claimed is:

1. A foil supply apparatus for supplying foil material producing foil bags, comprising at least two motor-driven supply rolls each for supplying foil material with a supply capacity, a withdrawal means for withdrawing the respective foil material from the respective supply roll with a withdrawal capacity, and a respective consumption sensor arranged between the supply rolls and the withdrawal means, with the help of which the drive of the respective supply roll is controlled in dependency of the consumption of foil material wherein said foil materials are brought together downstream of said respective consumption sensors to seal said foil materials to each other, said consumption sensors each comprising:

at least one stationary deflection roller configured to make rolling contact with the foil material, at least one movable sensor roller positioned a spacing distance from the at least one deflection roller, the sensor roller being configured to make rolling contact with the foil material and being movable under the force of gravity in a substantially vertical direction with respect to the stationary deflection roller such that the spacing distance changes in accordance with the difference between the supply capacity and the withdrawal capacity of the foil material and slack in the foil material is removed, a sensor means which senses the spacing distance and increases the speed of the drive of the respective supply roll when the spacing distance is smaller than a respective first predetermined distance, and which reduces the speed of the respective drive when a respective second predetermined distance is exceeded, a guide means along which the at least one sensor roller moves while the spacing distance is changed, the guide means being oriented in at least a substantially vertical orientation, a first signal for accelerating the drive when the spacing distance is smaller than the first predetermined distance, and a second signal for slowing but not stopping the drive when the spacing distance exceeds the second predetermined distance.

2. The apparatus according to claim 1 wherein the sensor means is designed such that it switches off the drive of the respective supply roll when a third predetermined distance is exceeded.

3. The apparatus according to claim 1 wherein the sensor roller is loaded with an additional weight.

4. The apparatus according to claim 1 wherein the number of the stationary deflection rolls exceeds the number of the sensor rollers by the number one and the foil material is alternately placed around the deflection rollers and the at least one sensor roller.

5. The apparatus according to claim 4 wherein the at least one sensor roller comprises at least two sensor rollers that are connected to each other.

6. The apparatus according to claim 1, further comprising a first safety sensor which produces an error signal when the spacing distance is smaller than a predetermined minimum distance.

7. The apparatus according to claim 6, further comprising a second safety sensor which produces a second error signal when the spacing distance exceeds a predetermined maximum distance.

8. The apparatus according to claim 6 wherein the safety sensor comprises a proximity switch.

9. The apparatus according to claim 6 wherein the safety sensor comprises an optical sensor element.

10. The apparatus according to claim 7 wherein at least one of the first and second sensors comprises a proximity switch.

11. The apparatus according to claim 7 wherein at least one of the first and second sensors comprises an optical sensor element.

12. The apparatus according to claim 11 wherein the optical sensor element comprises a light barrier.

13. The apparatus according to claim 6 wherein the error signal is used for switching off the withdrawal device and operational components that are used for the further processing of the foil supplied.

14. The apparatus according to claim 1 wherein the withdrawal means is intermittently driven.

15. The apparatus according to claim 1 wherein the motors of the supply rolls are driven by a joint control unit which receives the signals of the sensor means of the corresponding consumption sensors.

16. A method for supplying foil material in the production of foil bags wherein at least two webs of foil material are supplied each from a respective motor-driven supply roll, subsequently guided around at least one respective stationary deflection roller and at least one respective sensor roller whose distance from the at least one deflection roller varies under the force of gravity, and are finally withdrawn by a withdrawal means and are brought together to seal said foil webs to each other, the speed of the drive of the respective supply roller being increased when a spacing distance between the respective sensor roller and the respective deflection roller is smaller than a respective first predetermined distance, and the speed of the respective drive being decreased but not stopped when the spacing distance exceeds a second predetermined distance.

17. The method according to claim 16 wherein the drive of the supply roll is switched off when the spacing distance exceeds the second predetermined distance.

18. The method according to claim 16 wherein the withdrawal means and the operational components for the further processing of the foil are switched off when the spacing distance is smaller than a predetermined minimum distance.

19. The method according to claim 16 wherein at least the drive of the supply roll, the withdrawal means and the operational components for the further processing of the foil are switched off when the spacing distance exceeds a predetermined maximum distance.

20. The method according to claim 16 wherein the foil is intermittently withdrawn by the withdrawal means.

21. An apparatus for controllably supplying a foil material from a roll, the apparatus comprising:

a dispenser powered by a motor, the dispenser being configured to drive the roll and dispense the foil material at a supply rate, the motor being controllable to operate at variable speeds to adjust the supply rate;

a withdrawal means configured to withdraw the foil material from the dispenser at a withdrawal rate;

at least one sensor roller configured to rollably route the foil between the dispenser and the withdrawal means, the sensor roller being movable against the foil material transversely with respect to a line connecting the dispenser and the withdrawal means to remove slack from the foil material caused by the difference between the supply rate and the withdrawal rate of the foil material; and a spacing sensor configured to detect a spacing distance between the sensor roller and a location fixed with respect to the line, the spacing sensor being coupled to the motor to controllably accelerate the motor when the spacing distance is less than a first predetermined distance, and to decelerate but not stop the motor when the spacing distance is greater than a second predetermined distance.

* * * * *